US007621401B2

(12) United States Patent
Alegre de Miquel

(10) Patent No.: US 7,621,401 B2
(45) Date of Patent: Nov. 24, 2009

(54) CONTAINER SUITABLE FOR WET WIPES AND A CORRESPONDING REFILL PACK WITH COMPATIBILITY LOCK AND COMPATIBILITY ACTUATOR

(75) Inventor: Maria del Sagrado Corazon Alegre de Miquel, Liederbach (DE)

(73) Assignee: The Procter & Gamble Company, Cincinnati, OH (US)

( * ) Notice: Subject to any disclaimer, the term of this patent is extended or adjusted under 35 U.S.C. 154(b) by 686 days.

(21) Appl. No.: 11/406,615

(22) Filed: Apr. 19, 2006

(65) Prior Publication Data

US 2006/0283752 A1 Dec. 21, 2006

(30) Foreign Application Priority Data

Apr. 27, 2005 (EP) ..... 05009169

(51) Int. Cl.
*B65D 73/00* (2006.01)

(52) U.S. Cl. ..... 206/494; 206/233; 221/45; 221/46

(58) Field of Classification Search ..... 206/494, 206/233, 449, 210; 221/46, 61–63, 45, 48, 221/50, 303, 306; 220/212, 230, 254.1, 254.6, 220/281, 283, 834
See application file for complete search history.

(56) References Cited

U.S. PATENT DOCUMENTS

| | | | | |
|---|---|---|---|---|
| 2,984,380 | A | 5/1961 | Kuhnl et al. | |
| 4,535,912 | A * | 8/1985 | Bonk | 221/46 |
| 4,969,573 | A * | 11/1990 | Dupuis et al. | 220/258.5 |
| 5,531,325 | A | 7/1996 | Deflander et al. | |
| 6,065,626 | A | 5/2000 | Huang et al. | |
| 6,158,614 | A | 12/2000 | Haines et al. | |
| 6,206,221 | B1 * | 3/2001 | Bando et al. | 220/254.5 |
| 6,394,298 | B1 * | 5/2002 | Zaidman | 220/259.1 |
| 6,729,498 | B2 * | 5/2004 | Yelton et al. | 221/63 |
| 6,902,077 | B1 | 6/2005 | Tack et al. | |
| 7,021,483 | B2 | 4/2006 | Tack et al. | |
| 2003/0015544 | A1 | 1/2003 | Turbett et al. | |
| 2004/0035738 | A1 * | 2/2004 | Julius | 206/494 |
| 2005/0189367 | A1 * | 9/2005 | Chasid et al. | 221/35 |

FOREIGN PATENT DOCUMENTS

| | | |
|---|---|---|
| EP | 0 748 748 | 12/1996 |
| EP | 1 138 608 | 10/2001 |
| WO | WO 99/23003 A1 | 5/1999 |

OTHER PUBLICATIONS

U.S. Appl. No. 11/066,091, filed Feb. 25, 2005, Joshua James Norman.
U.S. Appl. No. 11/157,663, filed Jun. 21, 2005, Esther Abigail Villars et al.
PCT Search Report mailed Aug. 14, 2006, 4 pages.

* cited by examiner

*Primary Examiner*—David T Fidei
(74) *Attorney, Agent, or Firm*—Laura L. Whitmer; George H. Leal

(57) ABSTRACT

The invention relates to a refill pack of substantially flat articles such as wet wipes and to a container for such refill packs. The refill pack and the container have respectively a compatibility actuator and a compatibility lock to enable a selective compatibility between the refill pack and the container. The selective compatibility has the effect of enabling or impairing the opening of the containers lid.

18 Claims, 7 Drawing Sheets

CONTAINER SUITABLE FOR WET WIPES AND A CORRESPONDING REFILL PACK WITH COMPATIBILITY LOCK AND COMPATIBILITY ACTUATOR

FIELD OF THE INVENTION

This invention relates to a container suitable for substantially flat products such as wet wipes and to its corresponding refill pack. The invention further relates to the compatibility between a container and a refill pack.

BACKGROUND OF THE INVENTION

Substantially flat articles are of frequent use in the modern world: Wet wipes, dry wipes, toilet paper, pads for make-up removal, of which handkerchiefs are very common examples. Additionally to these cosmetic articles, other substantially flat articles are used for the cleaning and the care of many surfaces or objects: Hard surface cleaning wipes, floor cleaning tissues, disinfectant non-woven articles are also well known. Most of those articles are provided in containers enclosing a multiplicity of identical articles, usually in a stacked configuration. The containers are often made of hard synthetic material to allow repeated use of the container. Once the content of the container has been used, the container can be refilled by inserting a new stack of articles. The refill stack is usually provided separately and enclosed in a simpler and more economic flexible pack. Such packs are so-called "refill packs" or "refill pouches". For wet or moist articles, they are often made of a substantially flexible and water-impermeable film material.

Containers for wet wipes have been frequently described. Examples of those are provided in patent application WO 9923003A1 by S. Hill et al, in EP1000577A1 by J. Tacks et al, and in EP0630345B1 by J. Deflanker et al, assigned to The Procter & Gamble Company.

Refill pouches for wet wipes have in particular been described in US20030015544A1 by J. Turbett et al, and EP0999990B1 by P. Haines et al.

Containers and refill packs are usually designed to fit technically and commercially together. Dimensions, colors, icons, identification indicia, usage instructions and commercial messages are consistent between the two, enabling both an easy and efficient refill of the container by the refill pack as well as a clear identification of which refill pack should fit into which container.

For example, Pampers wipes® refill pouches bear the same colors and icons as the hard walled container intended to provide storage and dispensing for the user. Similarly flexible refill packs of Mr Proper® cleaning wipes have a design and indicia compatible with their corresponding hard walled container.

However, the push to provide products of lowest possible cost and best convenience to the users, tends to bring uniformity and standardization in the overall appearance of the flexible articles and of their containers: Many of the containers, for cleaning or for cosmetic articles, are made of hard polymeric resins and present a somewhat parallelepipedic body. Such containers often have a lid, a refill orifice and a dispensing orifice. Most of the wipes, whether for cleaning hard surfaces or for cleaning the skin a baby, tend to have dimensions fitting a human hand. Especially for wet-wipes, but also for dry wipes, many of the refill packs are made of a flexible film with a peel-off label covering a dispensing orifice and enabling an easy access to the articles.

There is a risk for human error in the use of refill packs with their associated containers. For example hard surface cleaning wipes refill packs could generally fit into containers originally intended for baby wipe. Hard surface cleaning wipes can obviously comprise chemicals that are neither intended nor desirable for use on human skin. Similarly the inadvertent placement of a refill pouch of baby wipes in a container for hard-surface cleaning wipes might lead to a undesirable experience when, for example, trying to wipe a glass surface with a baby wipe containing a skin ointment or a somewhat greasy lotion.

Less dramatic, but still not desirable, is the accidental mix-up between a refill pack of wipes and a container, when both are compatible with human skin use but have different characteristics. For example the unintended placement of a regular scented baby wipes in a container intended for unscented wipes, the unintentional placement and use of baby wipes (to be discarded as solid waste) into a container for adult toilet wipes (to be flushed away in toilet), the unintentional placement of regular wipes into a container of hypo-allergenic articles. All these examples are situations that can lead to user dissatisfaction, undesirable effects including allergic reactions or sewage, blockage and various other problems.

This mix-up problem is even more pronounced because the recognition of an incorrect match between refill pouch and container cannot be seen easily once the wrong refill has been inserted into a package. For many situations it will only be identified when the desired result of using the article is not achieved.

A physical incompatibility between refill packs and containers intended for different usage can be provided by intentionally providing shapes and dimensions of the refill packs and containers that are different for each type of article: For example a hard surface cleaning wipe can be manufactured in a special size only and packed in refill packs that physically prevents them to be inserted into a differently dimensioned container for baby wipes. However many flat articles need to be suited for the use by a human and need to correspond approximately to the size of a human hand. This dictates similar dimensions. As matter of fact, the multiplicity of manufacturers, the multiplicity of types of articles and of intended usages, prevents an efficient control of the risk of mix-up by using a simple size and shape compatibility between matching refill packs and containers.

Hence it is desirable to provide a container and a refill pack that efficiently helps preventing unintentional mixed-up. It is desirable to provide a refill pack that would only functionally fit into a corresponding container actually intended for the use with said refill pack.

It is desirable to provide a container that can only accept a defined type of refill packs for example for the same general purpose as the original or from the same manufacturer.

It is hence desirable to provide such a container/refill pack system that can decrease the frequency of mix-up or prevent it, while keeping the physical and functional characteristics of the substantially flat articles unaltered.

SUMMARY OF THE INVENTION

The invention provides a way to ensure a selective compatibility between a container and a refill pack of substantially flat articles such as wet wipes. This is achieved by providing a compatibility lock on the container and a compatibility actuator on the refill pack. The compatibility lock prevents the release of the container's lid in the absence of a compatible refill pack in the container. The compatibility lock enables the release of the lid upon actuation of the opening actuator when the compatibility actuator has actuated the compatibility lock. The refill pack of the invention comprises a compatibility actuator able to actuate the release of the lid of the container.

DETAILED DESCRIPTION OF THE INVENTION

Figure 1:
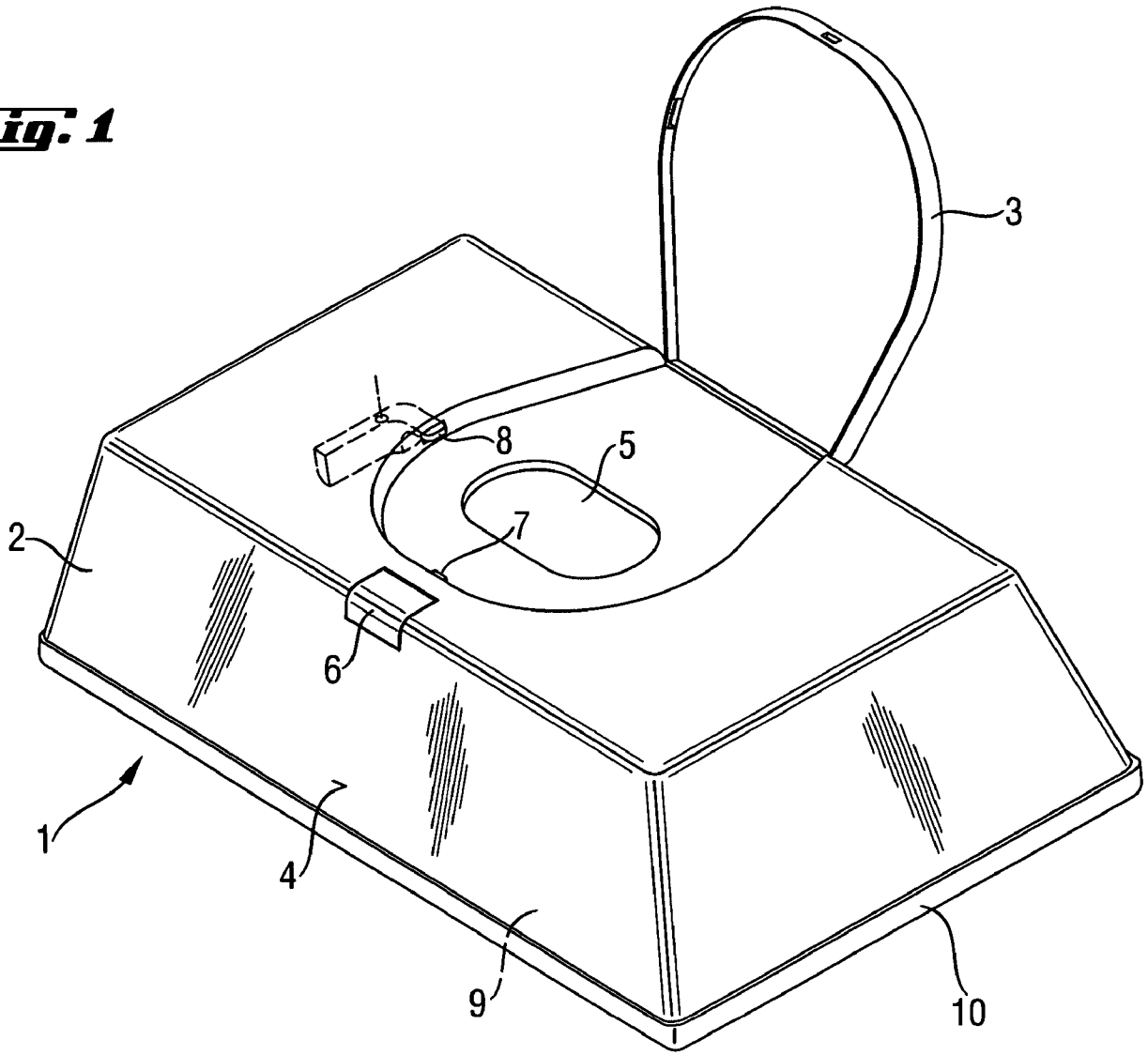
FIG. 1 is a perspective view of a container of the invention.

Definitions:

A "container", as used in the present invention is generally a hard walled structure that is intended to repeatedly facilitate the storage and the dispensing of substantially flat articles according to the invention. Usual containers are substantially parallelepipedic or trapezoidal, often with rounded edges. Containers are usually made of a polymeric synthetic resin. Part of the container can be made of a relatively softer material.

A "refill pack" as used in the present invention is a packaging structure that can be made of a flexible material such as a soft polymeric film. It encloses a stack of substantially flat articles. Refill packs are intended to be placed in an empty container. They are also called "refill pouches" or "packs".

"Substantially flat articles" also referred to as "flat articles" are articles of manufacture that have 2 dimensions largely exceeding the third one. By nature, substantially flat articles are stackable and usually are presented as stacks comprising 10, 20 or more units. In some stack configurations the flat articles are laid over each other in a folded or unfolded configuration. In other stacking configurations, the flat articles are interfolded. In the later, the removing of one flat article from the stack initiates and/or facilitates the removing of the next one from the stack. Examples of substantially flat articles used in the invention include: wet wipes and dry wipes intended to clean the urogenital and/or anal area of babies, kids or adults; facial wipes, disinfectant pads, make-up pads, generally skin-compatible wipes, hard surface cleaning wipes (for examples for glass surfaces, floors or surfaces of kitchen or bathroom furniture or appliances), soft surface cleaning wipes (for leather care for examples), handkerchiefs, kitchen towel, toilet paper, tissues, and related articles. The substantially flat articles of the invention include articles that comprise primarily cellulose based fibers (such as paper handkerchiefs), articles that comprise synthetic fibers (such as conventional baby wipes) or other natural fibers and articles including a plurality of fiber types. Preferred substantially flat articles used by the invention comprise non woven, possibly from spun-bonded, melt-blown or hydroentangled synthetic fibers. The synthetic fibers or fiber mix can include polyethylene, polypropylene, viscose, or cellulose-derived fibers such as Lyocell fibers. Alternatively or additionally, natural fibers can be provided alone or in combination with synthetic fibers. Cellulose based fibers are commonly used for paper handkerchiefs, tissues and kitchen towels.

The size of the flat articles used by the invention is primarily dictated by the intended use. In some instances the size of flat article is adapted to correspond approximately to the size of the user's hand or of the user's fingers. For some other usages the size is adapted to fit a device for using such flat articles (for example floor-cleaning wipes) or to fit the typical size of the surface on which the flat article is intended to be used. A typical first dimension of the flat articles (for example the length or the diameter) is between 1 cm and 50 cm, preferably between 5 cm and 25 cm, more preferably between 10 cm and 20 cm. A typical second dimension of the flat articles (for example width) is between 1 cm and 50 cm, preferably between 5 cm and 25 cm, more preferably between 10 cm and 20 cm. A typical third dimension, as the uncompressed thickness is between 0.1 mm and 15 mm, preferably between 0.2 mm and 3 mm. The articles can be constituted of a single ply or can comprise 2, 3, 4 or a multiplicity of identical or different plies.

Conventional Characteristics of Containers:

Conventional containers are intended to provide a structure to enclose a multiplicity of substantially flat articles. The description of conventional containers is exemplified in regard to usual containers for wet wipes. These containers typically comprise four side walls, a top wall, and a bottom wall—together forming the container body—, a dispensing orifice (usually on the top wall), a refill orifice, a lid usually articulated on the top wall and able to cover the dispensing orifice. Often the refill opening is part of the top or of the bottom wall—respectively forming so-called "top-loading" and "bottom loading" containers.

The containers can also comprise an opening actuator. The opening actuator can be in the form of a tab or a button or a finger grip that enables the opening of the lid, hence facilitating dispensing of the enclosed articles. Such tab, button or finger grip can be actuated by the action of the user. Such actuation can include pulling the actuator, pushing the actuator ("push button"), sliding, lifting, rotating or translating the actuator.

The lid is maintained in a closed position by a closure lock. The closure lock usually comprises a rigid piece that interferes with the displacement of the lid and prevents the opening of the lid until the actuator is actuated. Opening actuators and closure locks can be two separate pieces that can be functionally linked. Alternatively they can be one unitary piece having both functions.

To provide an automatic opening, an elastic means can also be part of the container: the elastic means biases the lid toward the open position after actuation of opening actuator. In a typical operation of a conventional container, the user pushes a button (=opening actuator) on the container body. The action on the push button moves the opening lock away from the lid. The elastic means releases its stored energy and promotes the movement of the lid into an open position. When re-closing the lid, the energy enabling the next opening is stored by the elastic means.

In other conventional containers, the user lifts or depresses a tab (=opening actuator) on the container's lid or container's body. The tab is mechanically linked or integrally joined to a protrusion i.e. the closure lock that restrains the lid from opening. The action on the opening actuator displaces the closure lock away from the lid. The lid consequently opens either automatically e.g. by the action of an elastic means or alternatively by manual action. The open lid enables the access to the substantially flat articles through the dispensing orifice.

Conventional Characteristics of Refill Packs:

Conventional refill packs for substantially flat articles are commonly made of a flexible synthetic film material such as polypropylene or polyethylene. The refill pack material stabilizes (holds together) and protects the stack of substantially flat articles. The refill pack has usually a dispensing orifice covered by a piece of material that can be displaced to free the dispensing orifice. Such piece of material can be provided as a self adhesive, resealable closure label or a rip-out portion of the packaging material eliminated by a line of weakness to facilitate removal. Ac closure label be larger than the dispensing orifice. Typical refill packs used in the invention have first dimension between 35 cm and 5 cm, preferably between 20 cm and 10 cm, a second dimension between 20 cm and 5 cm, preferably between 12 cm and 6 cm and a third dimension between 15 cm and 1 cm, preferably between 8 cm and 2 cm. Various other dimensions can be contemplated. The dimension of the refill pack must however be compatible with the size of the flat articles (folded or unfolded), with the size of the corresponding container and with the intended use.

The refill packs of substantially flat articles are usually inserted into the container through the refill orifice of the container by insertion of the refill pack in a position such that the dispensing orifice of the refill pack and of the containers correspond to each other. This enables an efficient and easy dispensing of the articles through both the dispensing orifice of the refill pack and the dispensing orifice of the container.

Containers According to the Invention:

Additionally to the features of a conventional container, the container according to the present invention comprises a compatibility lock. The function of the compatibility lock is to restrain or prevent the lid from opening until the compatibility lock is actuated by a compatibility actuator provided on the inserted refill pack. There are 3 basic embodiment options:

In a first basic embodiment of the invention the compatibility lock interacts directly with the lid. The compatibility lock comprises a part interfering with the opening of the lid. For example a protrusion of the compatibility lock engaging into a depression or opening of the lid near its edge or intersecting with its opening path can restrain it in a closed position.

In a second basic embodiment of the invention the compatibility lock interacts with the opening actuator to restrain the opening actuator from being effected. For example a part of a compatibility lock can impair the movement of a push-button (=opening actuator) and prevent it to be depressed, unless and until a compatibility actuator is provided with the matching refill pack placed in the container. Another example would be when the compatibility lock prevents the opening actuator to be efficiently depressed by a rigid support underneath the opening actuator and thus impairing its movement. During insertion of a matching refill pack into the container, the compatible compatibility actuator on the refill pack moves the compatibility lock away from the opening actuator (for example by a translation motion). This allows the opening actuator to be effected in order to open the container lid. In another embodiment the compatibility lock prevents the access to the opening actuator.

In a third basic embodiment of the invention the compatibility lock interacts with the closure lock. In case of an incorrect refill pack being used the compatibility lock impairs the movement of the closure lock, thus preventing the release of the lid. Upon actuation of the compatibility lock by a matching compatibility actuator, the closure lock is freed and can release the lid upon action of the user on the opening actuator.

Beside the 3 fundamental embodiments above, several variations and combinations can be considered. The compatibility lock could interact with both the closure lock and the opening actuator.

Further, the compatibility lock can comprise a rigid part (such as a protrusion in the material), preventing the movement of another movable part (such as the closure lock). Alternatively the compatibility lock can comprise an elastic means that biases the movement of either the container lid or of the opening actuator. As a further option, the compatibility lock can be an integral part of the opening actuator or can be separated therefrom.

Figure 7:
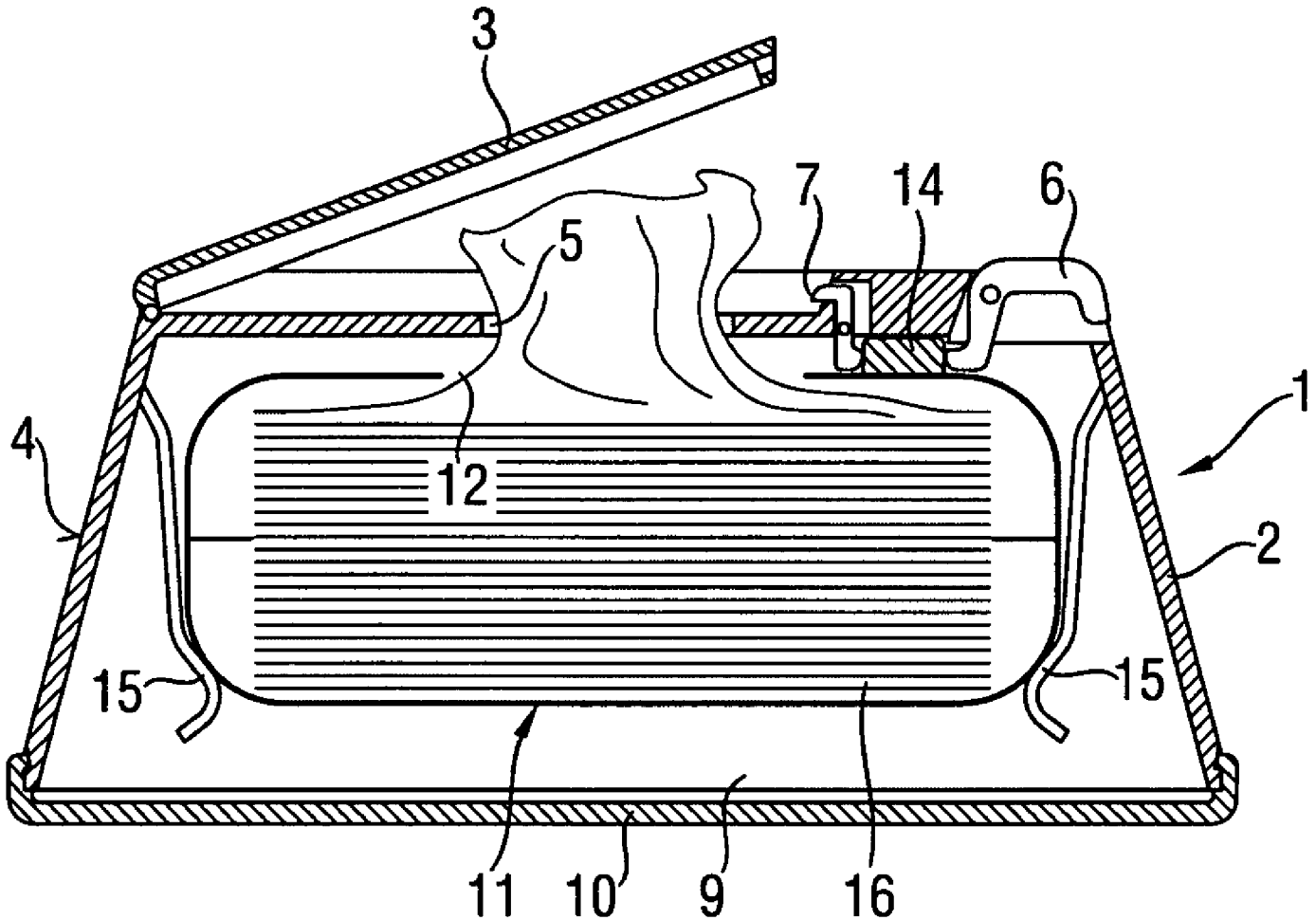
FIG. 7 is a cross section of a container and a refill pack of the invention.

In yet other embodiments, illustrated by FIG. 7, the compatibility lock (14) is an integral part of the closure lock (7). In this case, the closure lock has both functions (compatibility lock and closure lock). In this embodiment, in which the compatibility lock is an integral part of the closure lock or of the opening actuator, the compatibility lock is a part united with other parts of the container. For example, the compatibility actuator (14) on the refill pack (11) can affect directly the opening actuator and/or the closure lock. In some instances, the closure lock and compatibility lock are one unitary part having the two desired functions (compatibility lock and closure lock). Similarly the compatibility lock and the opening actuator can be provided as one unitary part having both functions (compatibility lock and opening actuator).

Refill Pack According to the Invention:

The refill pack according to the present invention comprises a compatibility actuator. The compatibility actuator, together with the compatibility lock of the container, provides for the selective compatibility between refill packs and containers. The compatibility actuator is designed to enter into a functional relationship with the compatibility lock of the container. The functional relationship is enabled when the compatibility actuator engages with or is employed by the compatibility lock of container, in particular during the insertion of the refill pack into the container body. The absence of a matching compatibility actuator on the refill pack will fail to enable the opening of the container lid.

The compatibility actuator can be of an integral part of the refill part or an attached part provided with the refill pack.

If the compatibility actuator is an integral part of the refill pack, it can be provided for example as a protrusion or a depression on the refill pack having a specific shape, position and/or dimension. In some embodiments the refill pack comprises an outside surface made of a flexible film material and has a compatibility actuator that is made of a relatively rigid material (similar to the material of the container or/and of the compatibility lock).

Figure 2:
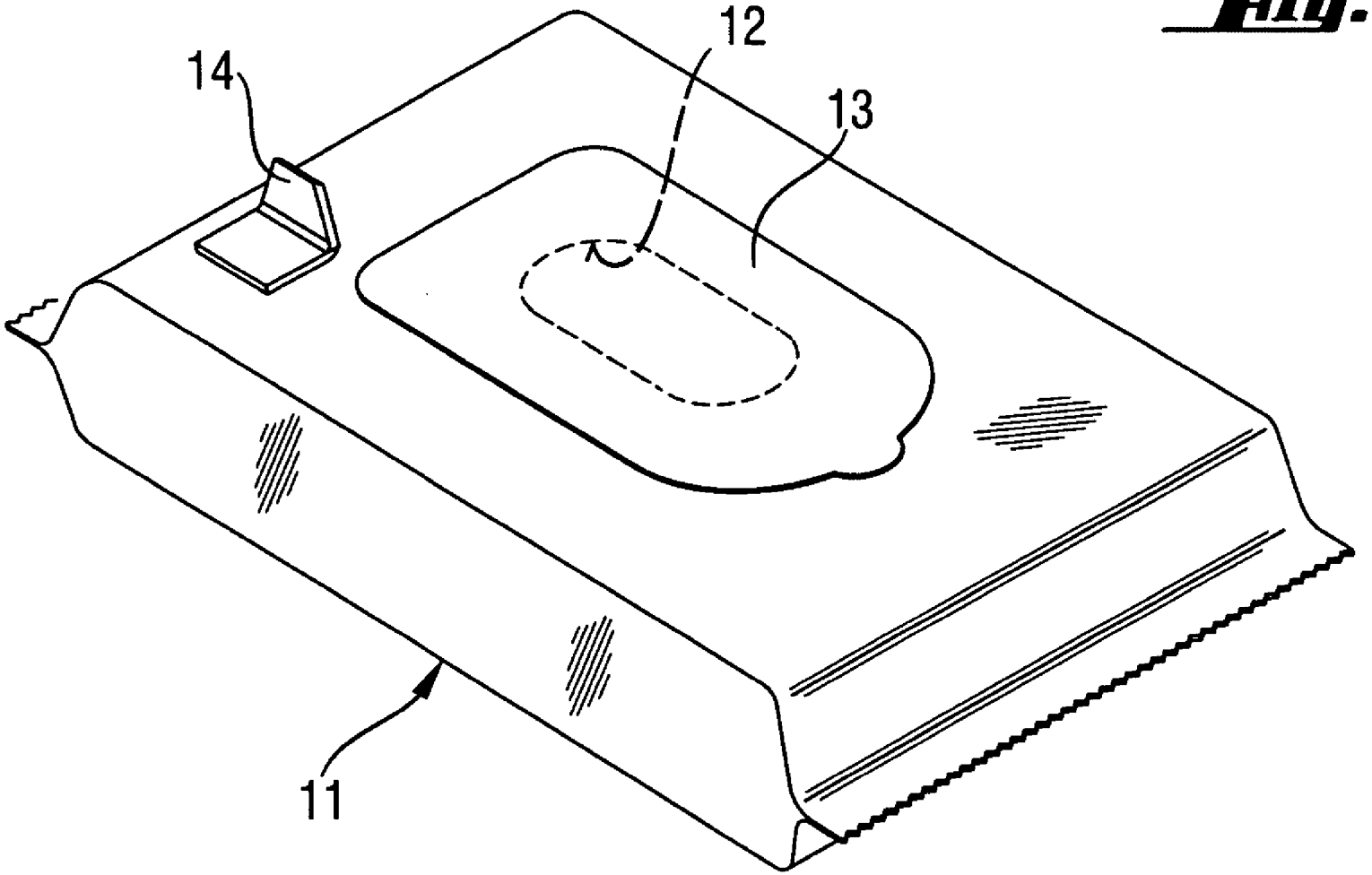
FIG. 2 is a perspective view of a flexible refill pack of the invention

Operation of the Invention:

The functional interactions, in use, of the embodiment of the invention shown in FIGS. 1 and 2 are: A container (1) of the invention comprises an opening actuator (6) in the form of a push button, a closure lock (7) and a lid (3) covering a dispensing orifice (5). The lid (3) of the empty container is maintained in a closed position by both the closure lock (7) and the compatibility lock (8). A refill pack (11) of substantially flat article is presented for insertion into the container (1) is shown in FIG. 2. If the refill pack comprises a compatible compatibility actuator (14) the insertion can be completed and the compatibility actuator (14) actuates the compatibility lock (8). Upon insertion the compatibility lock (8) moves away from the edge of the lid of the container. When the user operates the opening actuator (6), the closure lock (7) is released and the lid opens (for example by the action of an elastic means—not shown). If no matching compatibility actuator is present, the opening of the lid remains impaired.

In preferred embodiments of the present invention, the movement of the compatibility lock is merely enabled by the compatibility actuator on the refill pack being inserted into the container, without the need for the user to provide additional energy. Such movement is preferably a translation of a part of the compatibility lock under the force of the compatibility actuator on the refill pack being inserted. A rotation or a combination of translation and rotation of the compatibility lock are also contemplated.

Figure 3:
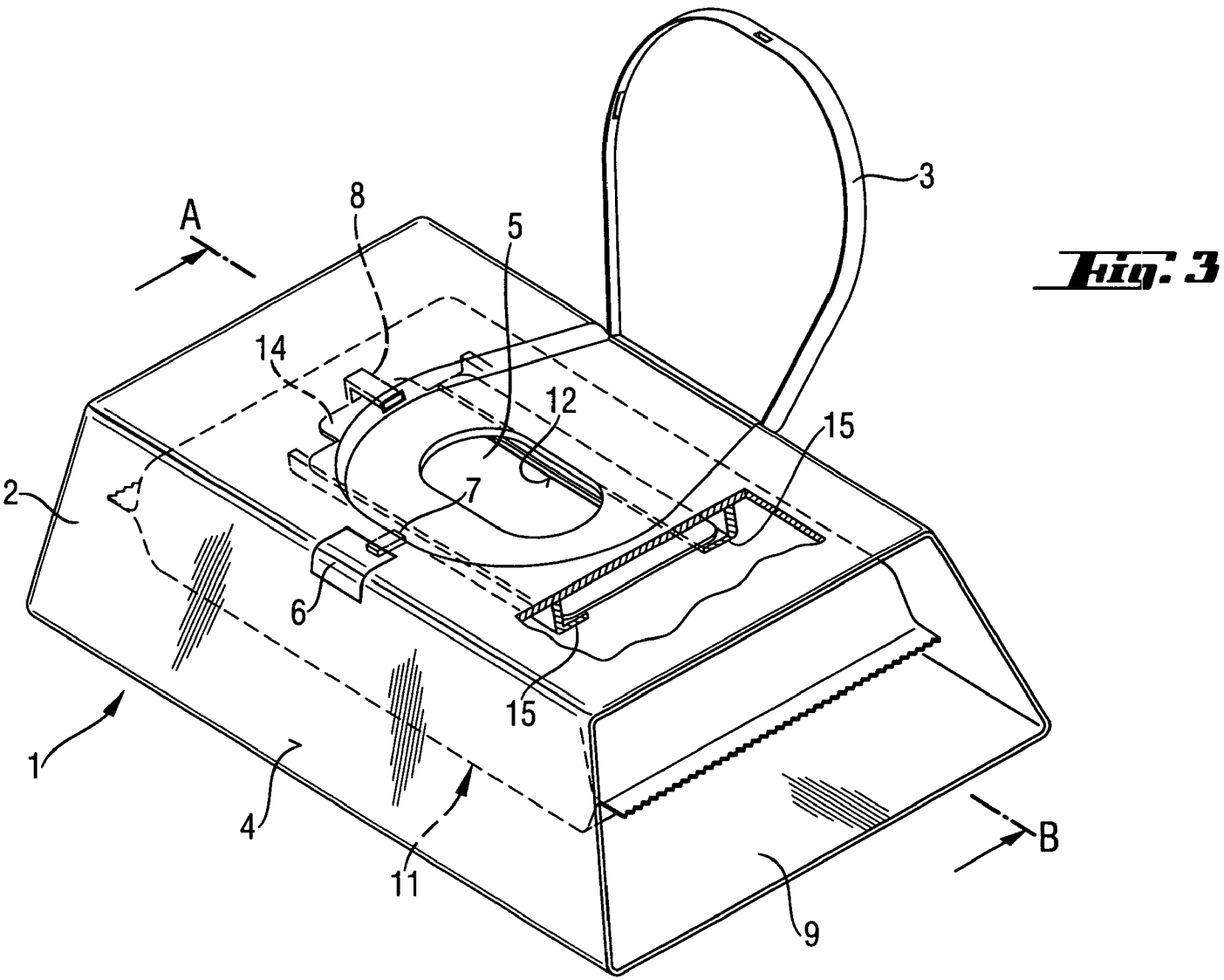
FIG. 3 is a perspective view of a container of the invention, partially cut away to show internal details and with the side refill opening cover removed.
Figure 6:
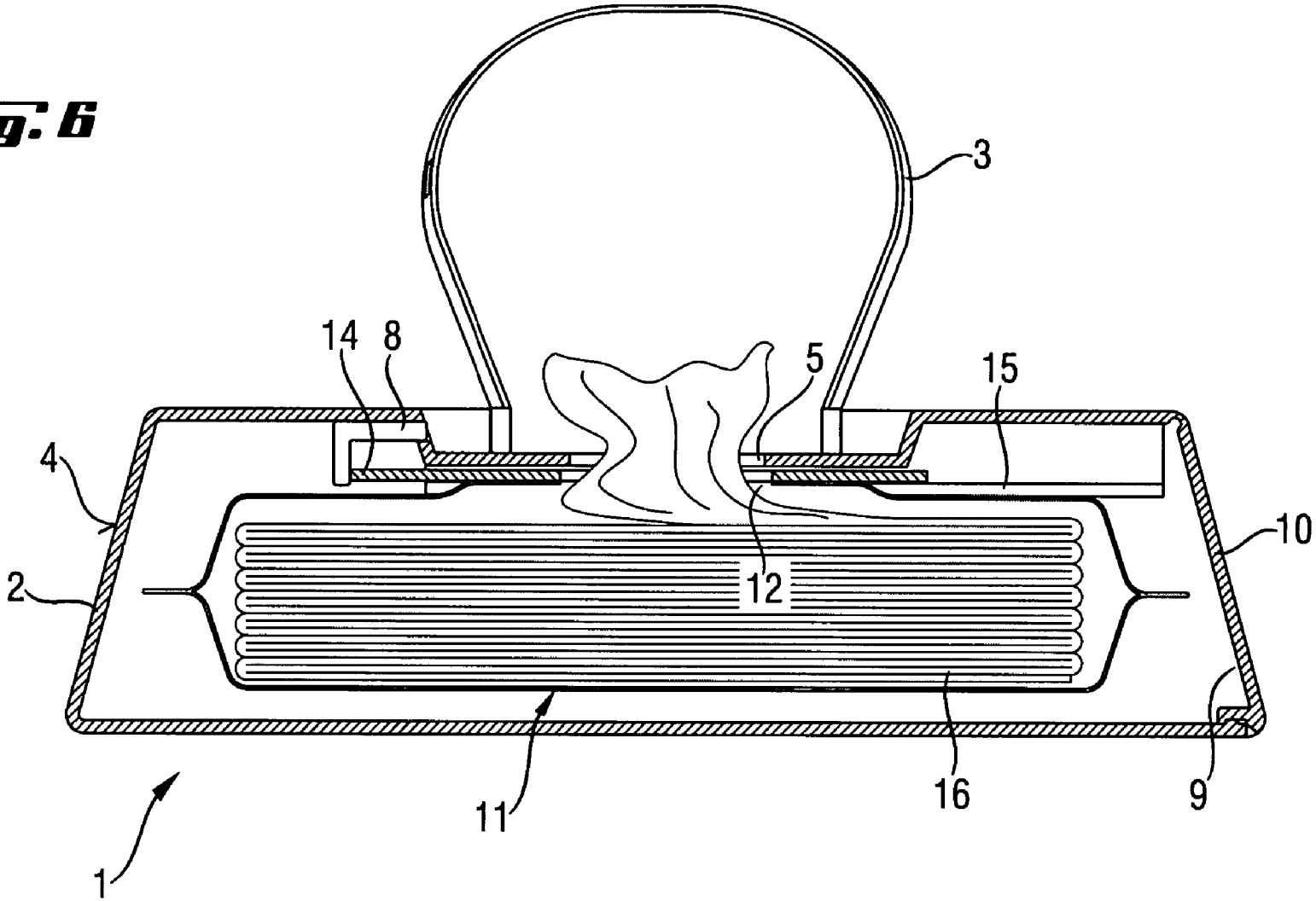
FIG. 6 is a cross section of the container of FIG. 3 along the line A<>B, with the lid in an open position and the compatible refill pack of FIG. 4 inserted in the container.

In the embodiments illustrated in FIGS. 3 and 6 the insertion of the refill pack into the body of the container is guided by a guiding structure in the container. This insures that the compatibility actuator is securely put in the right position to act on the compatibility lock. The guiding structure can comprise rails (15), ridges, protrusions, depressions or combination thereof on the container body inner side. In one embodiment the insertion of the refill pack into the container is lateral (insertion from the side) through a side opening, as the one shown as (9) on FIGS. 3 and 6, and covered by a refill opening cover (10).

In other embodiments, the movement of the compatibility lock is biased, facilitated or enhanced by an elastic means. The compatibility actuator hence can act directly on the compatibility lock or can act indirectly via an elastic means or via other movable parts.

In further embodiments the compatibility lock of the container and/or the compatibility actuator of the refill pack comprise a magnetic material (such as a magnet) and/or a magnetic responsive material (such as steel). The magnetic interaction can trigger and/or enhance the movements of the moving pieces and facilitate matching the refill pack and container. In a further alternative, the refill pack or parts of the refill pack (such as the compatibility actuator) can be maintained in place inside the container by hook-and-loop fixtures.

Selective Compatibility:

In summary the compatibility or the refill pack and compatibility lock of the container must functionally match: The matching can be a physical matching of their physical shapes or dimension (type "key—keyhole"). Alternatively the matching can be a "position match", possibly enabled by container parts such as ridges or protrusions on the container body. In other alternatives, the match is provided by material characteristics such as flexibility, rigidity, magnetic properties, and adhesiveness of the surface. The prevention of mismatch of flat articles by insertion of a refill pack into a container is achieved by the presence of a matching compatibility actuator on the refill pack. When present on the refill packs, the compatibility actuators can also provide the benefit of selective compatibility.

Compatibility locks and actuators can be selective such as to enable only one actuator or type of actuator to match with a given compatibility lock. The invention also contemplates compatibility locks and actuators forming matching families. Families of actuators can be compatible with specific compatibility locks or families of compatibility locks. For examples, actuators used on refill packs for baby wipes of a certain manufacturer can be compatible with a specific family of compatibility locks only used on baby wipes containers of that manufacturer only. Within the same family, compatibility locks and actuators are all compatible amongst each other. For example the compatibility actuator of a first family (of hard surface cleaning wipes) is not compatible with a capability lock on the containers of a second family of baby wipes. This prevents undesired mismatches, while allowing a diversity of refill packs within a family of packs to be used with a matching family of containers.

Families of compatibility can be established based on the ingredients in the substantially flat articles, to their intended usage, to the manufacturer or the brand of the articles or according to any other sensible grouping.

EXAMPLE 1

FIG. 1 and FIG. 2 show one embodiment of the refill pack (11) of the invention and one embodiment of the container (1) of the invention. The refill pack (11) is a refill pack for wet wipes and is made of a thin flexible film. It has a dispensing orifice (12) through which the wet wipes can be dispensed. The dispensing orifice (12) is covered, when not in use, by a resealable label (13) that protects the content of the refill pack (11) from dust and contamination while reducing evaporation of the wipes lotion. The refill pack (11) presents a compatibility actuator (14) on its upper surface. The compatibility actuator is made from a relatively rigid resin material. The compatibility actuator (14) has dimension, shape and location on the refill pack that are compatible with the compatibility lock (8) of the container (1) of FIG. 1. The container (1) is made of relatively rigid polymeric synthetic resin material. It has a substantially parallelepipedic body (2) with 4 side walls (4) and an upper wall. The bottom part forms a refill orifice (9) that can be covered by a removable refill opening cover (10) thus forming a bottom wall. The upper wall has a dispensing orifice (5) through which flat articles can be dispensed. A lid (3) is hingedly connected to the container and can cover the dispensing orifice (5) when closed. A closure lock (7) biases the opening of the lid (3) and restrains it in a closed position. An opening actuator (6), in a form of a press-button, is located on the upper part of the front wall of the container, extending to its top wall. The opening actuator is functionality connected to the closure lock in such a way that the closure lock (7) releases the lid upon actuation of the opening actuator (6) by a user. The lid can be biased by an elastic member (e.g. spring or elastic polymer—not shown) that urges it into an open position upon release of the closure lock (7). Additionally to the closure lock (7), a compatibility lock (8) also restrains the opening of the lid (3). The compatibility lock is moved into a non restraining position upon insertion of a refill pack (11) having a compatible compatibility actuator (14) through the refill opening (9). The insertion of a non compatible refill pack or of a refill pack not having a compatible compatibility actuator does not enable the release of the lid (3).

EXAMPLE 2

Figure 4:
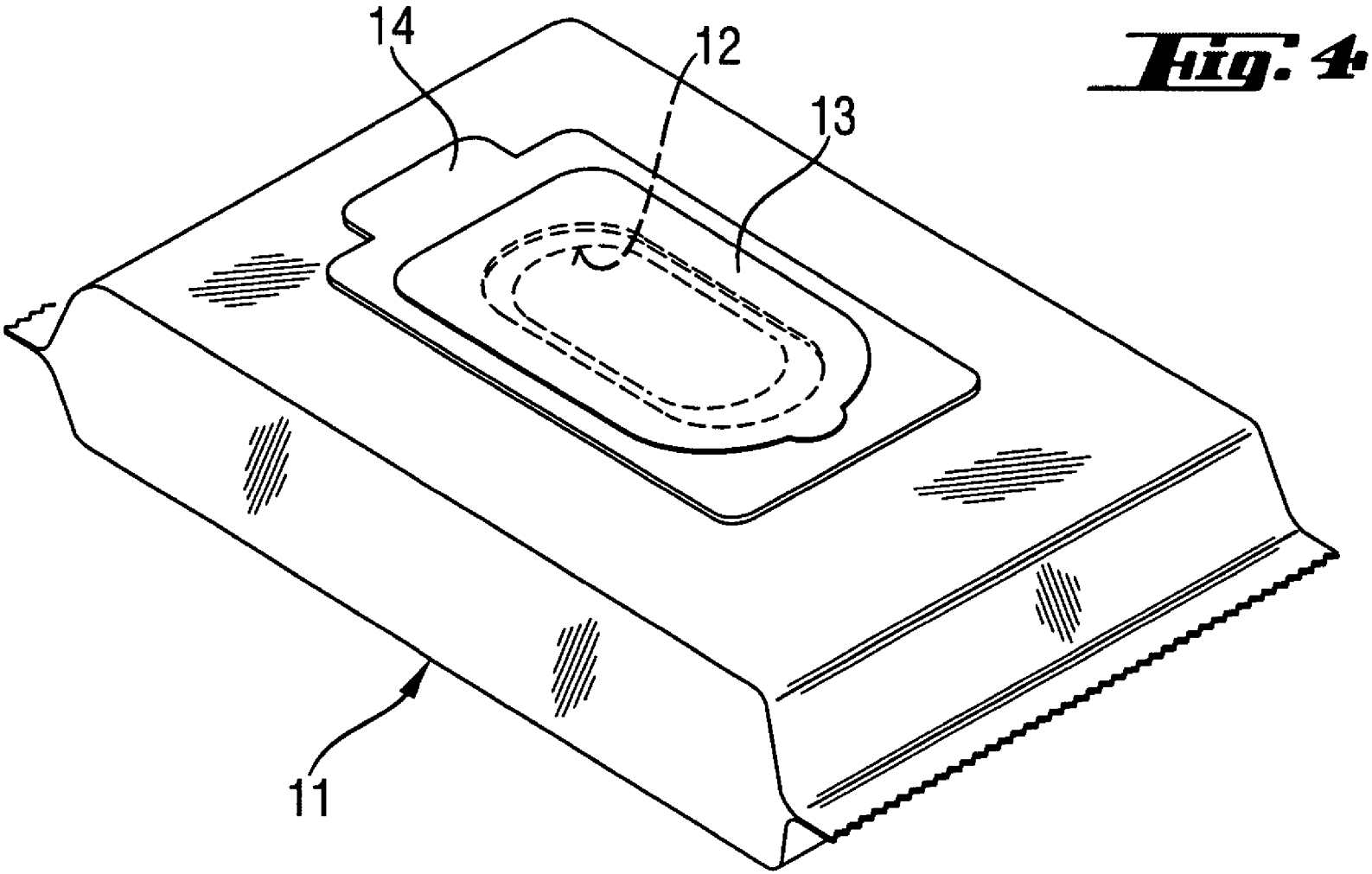
FIG. 4 is a perspective view of a flexible refill pack of the invention
Figure 5:
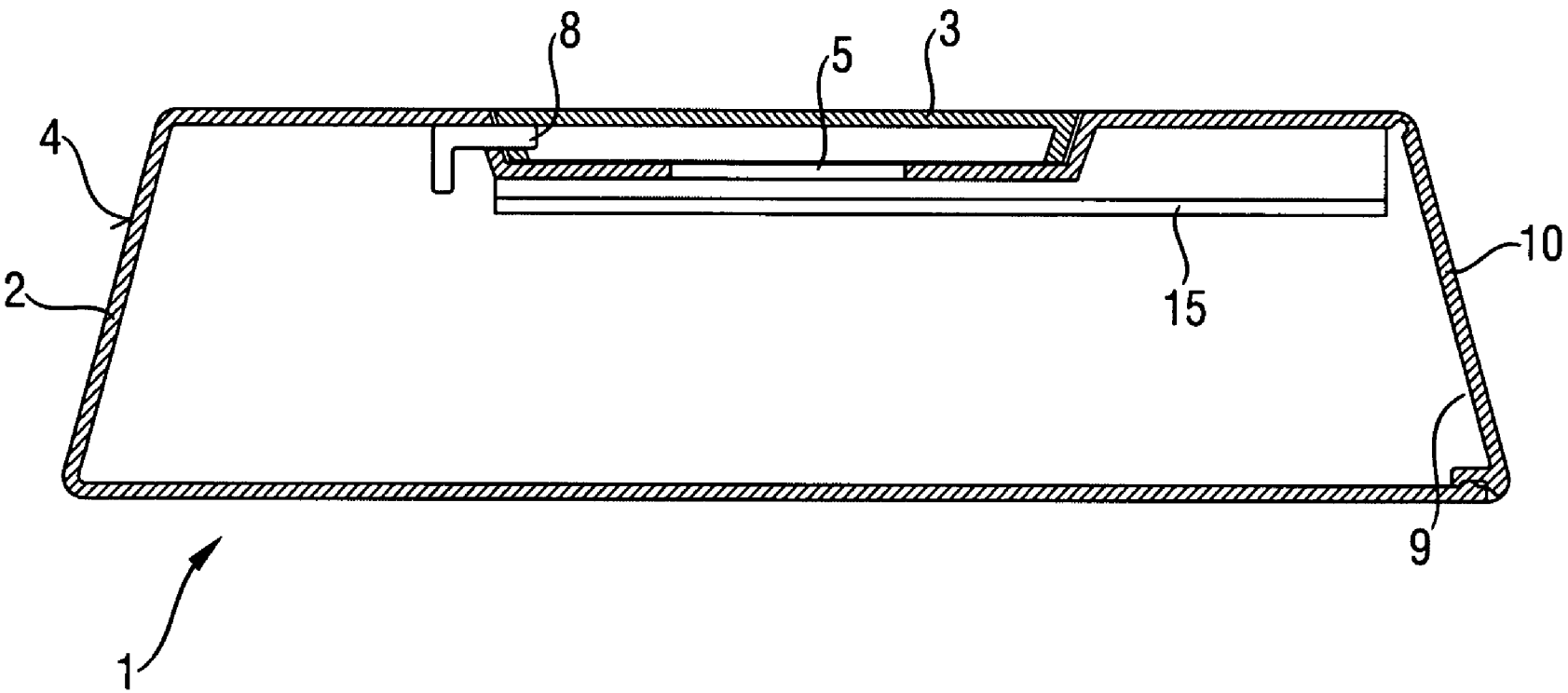
FIG. 5 is a cross section of the container of FIG. 3 through the line A<>B, with the lid in a closed position.

FIGS. 3, 4, 5, 6 illustrate another embodiment of the invention. The general principles and features of the refill pack and container are similar to the one described for the example 1. The compatibility actuator (14) of the refill pack (11) of FIG. 4 is however of a different shape: It is made of relatively flat and relatively rigid piece of material. It surrounds the orifice (12) of the refill pack (11), while not covering it. The dispensing is covered for transport and storage by a resealable label (13). The central part of the compatibility actuator is attached to the refill pack (11) whereas the periphery of the compatibility actuator is not attached to the surface of the refill pack (11). The container (1) of FIGS. 3, 5, 6 has guiding rails (15) on its body for guiding the insertion, positioning and supporting the refill pack (11) in the container (1). The peripheral part of the compatibility actuator (14) can engage into the guiding rails (15) of the container body. An end part of the compatibility actuator (14) can engage against a compatibility lock (8) of the refill pack. During insertion of the refill pack (11) into the container (1) through the refill opening (9) located on a side wall of the container (1), the compatibility actuator engages into the guiding rails (15) and contacts the compatibility lock (8). When the compatibility actuator and compatibility lock fit together, the compatibility lock is translated away and it moves away from the lid. Not being restrained any longer by the compatibility lock (8), the lid (3) can respond to the actuation of the opening actuator (6) that moves the closure lock (7) and releases the lid (3). The lid is biased to an open position by an elastic member (not shown).

EXAMPLE 3

FIG. 7 shows an embodiment of the invention in which compatibility actuator (14) interacts with both the opening actuator (6) and the closure lock (7). A refill pack (11) enclosing a stack (16) of wet wipes can be inserted into the container (1) through a refill opening (9) located on the bottom side of the container. The refill opening can be closed by a refill opening cover (10). Guiding rails (15), flexibly mounted on the inner side of the containers body, guide the insertion of the refill pack (11) and maintain it in a suitable position after insertion. Upon insertion the compatibility actuator (14) located on the upper surface of the refill pack (11) engages with the opening actuator (6) and the closure lock (7). In the embodiment of FIG. 7, the closure lock (7) and the compatibility lock of the invention are merged into a single integral piece having both functions. The presence of the compatibility actuator enables the transmission of the impulse (provided by the user) from the opening actuator to the closure lock (7). When the opening actuator is pressed, the closure lock releases the lid (3) which opens by the action of an elastic member (not shown). Only a compatible compatibility actuator (14) on the refill pack (11) can transmit the impulse and enable the operation of the container lid. Compatibility in this case depends in particular on the size, shape and position of the actuators and locks.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A container for a refill pack of substantially flat articles, said refill pack comprising a compatibility actuator, said container comprising a container body, a reclosable container lid, a dispensing orifice, a refill orifice, an opening actuator, a closure lock and a compatibility lock, said lid covering said dispensing orifice when said lid is in closed position and said lid freeing said dispensing orifice when said lid is in open position, said closure lock restraining the opening of said lid when said lid is in closed position, and releasing said lid when said opening actuator is actuated, wherein said compatibility lock prevents the release of said lid upon actuation of said opening actuator in the absence of said refill pack, and wherein said compatibility lock enables the release of said lid when said compatibility actuator actuates said compatibility lock.

2. The container of claim 1 wherein said compatibility lock is actuated by said compatibility actuator by the insertion of said refill pack into said container body through said refill orifice.

3. The container of claim 1 wherein said compatibility lock and said closure lock are a unitary piece.

4. The container of claim 2 wherein said compatibility lock and said closure lock are a unitary piece.

5. The container of claim 1 wherein said container further comprises a guiding structure comprising guiding rails which guide said refill pack and/or said compatibility actuator to a position in which said compatibility actuator actuates said compatibility lock.

6. The container of claim 2 wherein said container further comprises a guiding structure comprising guiding rails which guide said refill pack and/or said compatibility actuator to a position in which said compatibility actuator actuates said compatibility lock.

7. The container of claim 3 wherein said container further comprises a guiding structure comprising guiding rails which guide said refill pack and/or said compatibility actuator to a position in which said compatibility actuator actuates said compatibility lock.

8. The container of claim 1 wherein said compatibility lock comprises a magnetic material or a magnetic responsive material and is actuated by a magnetic action.

9. The container of claim 2 wherein said compatibility lock comprises a magnetic material or a magnetic responsive material and is actuated by a magnetic action.

10. The container of claim 3 wherein said compatibility lock comprises a magnetic material or a magnetic responsive material and is actuated by a magnetic action.

11. The container of claim 4 wherein said compatibility lock comprises a magnetic material or a magnetic responsive material and is actuated by a magnetic action.

12. The container of claim 5 wherein said compatibility lock comprises a magnetic material or a magnetic responsive material and is actuated by a magnetic action.

13. The container of claim 6 wherein said compatibility lock comprises a magnetic material or a magnetic responsive material and is actuated by a magnetic action.

14. The container of claim 7 wherein said compatibility lock comprises a magnetic material or a magnetic responsive material and is actuated by a magnetic action.

15. The container of claim 1 wherein said compatibility actuator is configured such that the compatibility actuator actuates the compatibility lock during the insertion of said refill pack into said container body.

16. The container of claim 15 wherein said compatibility actuator comprises a magnetic material or a magnetic responsive material and actuates by magnetic action.

17. The container of claim 15 wherein said refill pack comprises an outside surface made of a thermoplastic film, and wherein said compatibility actuator is made of material which is relatively more rigid than said thermoplastic film.

18. The container of claim 1 wherein said substantially flat articles are wet wipes.

* * * * *

UNITED STATES PATENT AND TRADEMARK OFFICE

CERTIFICATE OF CORRECTION

PATENT NO. : 7,621,401 B2
APPLICATION NO. : 11/406615
DATED : November 24, 2009
INVENTOR(S) : Maria del Sagrado Corazon Alegre de Miquel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 889 days.

Signed and Sealed this

Twenty-sixth Day of October, 2010

David J. Kappos

David J. Kappos
*Director of the United States Patent and Trademark Office*